US009932869B2

(12) United States Patent
An et al.

(10) Patent No.: US 9,932,869 B2
(45) Date of Patent: Apr. 3, 2018

(54) CRANKCASE VENTILATION APPARATUS

(71) Applicant: Mahle International GmbH, Stuttgart (DE)

(72) Inventors: Dimitri An, Stuttgart (DE); Steve Beez, Masserberg (DE); Armando Coelho, Stuttgart (DE); Alfred Elsaesser, Keltern (DE); Thomas Fallscheer, Stuttgart (DE); Volker Kirschner, Muehlacker (DE); Thomas Riemay, Korb (DE); Stefan Ruppel, Heidelberg Emmertsgrund (DE)

(73) Assignee: Mahle International GmbH (DE)

( * ) Notice: Subject to any disclaimer, the term of this patent is extended or adjusted under 35 U.S.C. 154(b) by 110 days.

(21) Appl. No.: 14/941,227

(22) Filed: Nov. 13, 2015

(65) Prior Publication Data

US 2016/0138442 A1 May 19, 2016

(30) Foreign Application Priority Data

Nov. 14, 2014 (DE) ..... 10 2014 223 290

(51) Int. Cl.
*F01M 13/02* (2006.01)
*F01M 13/00* (2006.01)
(Continued)

(52) U.S. Cl.
CPC ..... *F01M 13/021* (2013.01); *F01M 13/00* (2013.01); *F01M 13/02* (2013.01);
(Continued)

(58) Field of Classification Search
CPC ..... F01M 13/04; F01M 2013/0422; F01M 2001/1021; F01M 2013/027; F01M 2013/0433; F01M 13/00
See application file for complete search history.

(56) References Cited

U.S. PATENT DOCUMENTS 3,589,347 A * 6/1971 Sawada ..... C21C 5/30 123/572
4,557,226 A 12/1985 Mayer et al.
(Continued)

FOREIGN PATENT DOCUMENTS

DE 102013202348 A1 8/2013
DE 112011105854 T5 8/2014
(Continued)

OTHER PUBLICATIONS

Machine translation of EP0142092A2.*
(Continued)

*Primary Examiner* — Long T Tran
(74) *Attorney, Agent, or Firm* — Fishman Stewart PLLC

(57) ABSTRACT

A vehicle may include an internal combustion engine having a crankcase and a supercharging apparatus, and a crankcase ventilation apparatus having at least one oil-separating apparatus including at least one oil separator. An oil return line may communicate separated oil from the crankcase ventilation apparatus to the crankcase. An ejector pump may be driven via a compressed air flow of the supercharging apparatus and may be configured to generate an underpressure for driving a blow-by gas. The crankcase ventilation apparatus may include a pump control valve configured to at least one of regulate and control the compressed air flow through the ejector pump.

20 Claims, 13 Drawing Sheets

(51) Int. Cl.
*F01M 13/04* (2006.01)
*F02D 23/00* (2006.01)

(52) U.S. Cl.
CPC ..... *F01M 13/023* (2013.01); *F01M 13/04* (2013.01); *F02D 23/00* (2013.01); *F01M 2013/005* (2013.01); *F01M 2013/0016* (2013.01); *F01M 2013/0044* (2013.01); *F01M 2013/0066* (2013.01); *F01M 2013/026* (2013.01); *F01M 2013/027* (2013.01); *F01M 2013/0427* (2013.01)

(56) References Cited

U.S. PATENT DOCUMENTS 4,791,896 A * 12/1988 Bidwell ..... F02M 25/00 123/193.3
7,007,682 B2 * 3/2006 Takahashi ..... F01M 13/022 123/572
7,712,456 B2 * 5/2010 Hirano ..... F01M 13/021 123/572
7,870,850 B2 * 1/2011 Herman ..... F01M 13/04 123/572
8,607,767 B2 * 12/2013 Ruppel ..... F01M 13/021 123/572
8,813,731 B2 8/2014 Hattori et al.
8,915,237 B2 * 12/2014 Copley ..... B01D 45/08 123/41.86
2003/0000508 A1 * 1/2003 Takahashi ..... F01M 13/022 123/572
2009/0308364 A1 12/2009 Konohara
2011/0073082 A1 3/2011 Hattori et al.
2012/0159912 A1 * 6/2012 Ruppel ..... B01D 45/08 55/462
2012/0318215 A1 * 12/2012 Copley ..... B01D 45/08 123/41.86
2014/0165977 A1 * 6/2014 Copley ..... B01D 45/08 123/573
2014/0257672 A1 * 9/2014 Surnilla ..... F02M 25/089 701/103
2015/0020785 A1 * 1/2015 An ..... F01M 13/02 123/572
2015/0053188 A1 2/2015 Kuribayashi et al.

FOREIGN PATENT DOCUMENTS

EP 0142092 A2 5/1985
JP S63158516 U 7/1998
JP 2012229705 A 11/2012
WO WO-2013/017832 A1 2/2013

OTHER PUBLICATIONS

European Search Report EP 15193729.9, dated Apr. 14, 2016.
English Abstract for JP-2012229705-A.
English abstract for DE-102013202348.

* cited by examiner

CRANKCASE VENTILATION APPARATUS

CROSS-REFERENCE TO RELATED APPLICATIONS

This application claims priority to German Patent Application No. 10 2014 223 290.2, filed Nov. 14, 2014, the contents of which are hereby incorporated by reference in its entirety.

TECHNICAL FIELD

The invention relates to a vehicle having an internal combustion engine, which has a crankcase and a supercharging apparatus, having a crankcase ventilation apparatus, which has an inertia-based oil-separating apparatus with at least one inertia-based oil separator, an oil return, which returns separated oil to the crankcase, and an ejector pump, which is driven using compressed air of the supercharging apparatus and which generates an underpressure, in order to drive blow-by gas.

BACKGROUND

Most motor vehicles are equipped with an internal combustion engine, which is generally used for driving the vehicle. An internal combustion engine of this type has a crankcase, preferably if it is designed as a piston engine. A crankshaft is located in the crankcase, which is connected via connecting rods to pistons of the individual cylinders of the internal combustion engine. Leaks between the piston and the associated cylinder walls lead to a blow-by gas flow, by means of which, blow-by gas reaches the crankcase from the combustion chambers. To prevent an unpermitted overpressure in the crankcase, modern internal combustion engines are equipped with a crankcase ventilation apparatus, in order to dissipate the blow-by gases from the crankcase.

To reduce hazardous emissions, the blow-by gas is conventionally fed with the aid of the crankcase ventilation apparatus to a fresh air system of the internal combustion engine, which supplies the combustion chambers of the internal combustion engine with fresh air. An oil mist prevails in the crankcase, so that the blow-by gas conveys oil with it. This oil may, as oil droplets, damage elements in the intake tract, such as a turbocharger, for example. In order to protect these elements and to reduce the oil consumption, the crankcase ventilation apparatus conventionally has an oil-separating apparatus and preferably an oil return, which returns the separated oil to the crankcase.

In the case of crankcase ventilation apparatuses, passive systems can be differentiated fundamentally from active systems. Passive systems use the pressure difference between the crankcase and the underpressure in the fresh air system for driving the blow-by gas. Active systems additionally generate an underpressure for exhausting the blow-by gas out of the crankcase. As a result, a higher pressure difference can be used in the oil separation, so that the separation is improved. In supercharged internal combustion engines, for example by means of a compressor or turbocharger, it is known to use an ejector pump, which is driven by the compressed air of the supercharging apparatus and therefore generates an underpressure, with the aid of which a higher differential pressure can be generated.

In exhaust turbochargers in particular, the responsiveness of the internal combustion engine can be reduced considerably in the case of partial load or idling as a result, because energy is removed in the supercharging apparatus when there is only little energy present anyway owing to the low power of the engine.

A crankcase ventilation apparatus is for example known from WO 2013/017832 A1, in which an underpressure is generated for ventilating the crankcase by means of an ejector pump. In this case, the ejector pump is driven by compressed air from a turbocharger.

SUMMARY

The present invention is based on the object, for a vehicle of the type mentioned at the beginning, of specifying an improved embodiment, which stands out in particular due to a better responsiveness of the internal combustion engine. At the same time, a high efficiency should be realised with regards to the oil separation action.

This object is solved according to the invention by means of the subject matters of the independent claim(s). Advantageous embodiments are the subject matter of the dependent claims.

The invention is based on the general idea of constructing the crankcase ventilation apparatus in such a manner that the power of the ejector pump is automatically set in accordance with need. As a result, an improved crankcase ventilation can be achieved without an additional control apparatus and without negatively influencing the responsiveness of the internal combustion engine. It is essential to the invention in this case that the crankcase ventilation apparatus comprises a pump control valve, which regulates and/or controls the flow of the compressed air through the ejector pump, and which has a closure part, which is arranged in a force-loaded manner against a valve seat and is lifted out of the valve seat counter to the force if a pressure difference between a valve inlet and a valve outlet is exceeded, so that the pump control valve is opened. In this manner, the pump control valve is opened specifically when the supercharging apparatus has generated a sufficiently high boost pressure. The start of the supercharging apparatus, particularly of an exhaust turbocharger, is not negatively influenced as a result. The ejector pump is switched on in these operating states, in which the supercharging apparatus is generating compressed air satisfactorily. Furthermore, these operating states, in which the supercharging apparatus is generating a high boost pressure, are also characterised by a high power of the internal combustion engine, and in which large volumetric flows of blow-by gas reach the crankcase, so that switching on the ejector pump is particularly beneficial in these states.

An advantageous variant provides that the pump control valve is an own-medium-actuated valve. As a result, no control line is required to control and/or regulate the pump control valve. Also, no additional energy has to be provided. Thus, a very simple and cost-effective design can be achieved.

In the description and the attached claims, an own-medium-actuated valve is understood to mean a valve in which the medium to be controlled is the same medium as the medium controlling the valve. Examples for own-medium-actuated valves are non-return valves and pressure-relief valves.

A beneficial option provides that the force, with which the closure part is loaded against the valve seat, is a spring force. Spring-force-loaded valves are particularly simple to produce and are reliable in operation.

A further beneficial option provides that the force, with which the closure part is loaded against the valve seat, is a magnetic force. The use of magnetic forces on the one hand offers an option of contactless force transmission and on the other hand, the magnetic forces can additionally be influenced by electromagnets, so that the behaviour of the pump control valve can be adjusted and/or influenced.

A particularly beneficial option provides that the force, with which the closure part is loaded against the valve seat, is a pneumatic force generated by a pressure. A pneumatic force of this type can for example be generated by a gas-filled cavity covered with a membrane, or by a gas-filled cylinder. This pneumatically generated force is proportional to the deflection in this case, like the force of a spring, so that the pump control valve can beneficially be adapted to the crankcase ventilation apparatus.

A further particularly beneficial option provides that the pump control valve is a proportional valve, wherein the pump control valve can continually find itself between a closed position, in which the pump control valve is closed, and a passage position, in which the pump control valve is completely open. In this manner, a continuous control and/or regulation of the ejector pump is possible, so that the power of the ejector pump can beneficially be adapted to the available boost pressure of the supercharging apparatus.

An advantageous solution provides that the oil-separating apparatus has at least three work areas, wherein a flow cross section of the oil-separating apparatus is constant in a first work area, wherein in a second work area, the flow cross section of the oil separating device increases with increasing pressure difference between inlet and outlet of the oil-separating apparatus, and wherein in a third work area, the flow cross section of the oil-separating apparatus increases less sharply with increasing pressure difference than in the second work area. Advantage, see above.

A further advantageous solution provides that the inertia-based oil-separating apparatus has at least two inertia-based oil separators, and in particular a control apparatus switches between the at least two oil separators depending on the power of the ejector pump. In this manner, one of the oil separators can be designed for low volumetric flows and low pressures, whilst the second oil separator is designed for larger pressure differences, which can be achieved if the ejector pump is switched on. Better separation rates can be achieved in this manner.

A particularly advantageous option provides that the oil-separating apparatus has two oil separators, which in each case have a spring-loaded poppet valve, which opens with increasing inlet-side pressure, that the poppet valve of one of the oil separators is a low-pressure poppet valve, that the poppet valve of the other oil separator is a high-pressure poppet valve, and that the low-pressure poppet valve opens at a lower pressure than the high-pressure poppet valve. In this manner, a good oil separation rate can be achieved both with and without the support of the ejector pump.

A further particularly advantageous option provides that the high-pressure poppet valve only opens at a pressure at which the low-pressure valve is already maximally open. In this manner, the two work areas of the oil-separating apparatus are separated from one another particularly well.

It is advantageous if the inertia-based oil-separating apparatus has an oil separator with a pressure/volume characteristic with at least three, preferably at least four different areas. The different areas are differentiated in particular by means of the relation between pressure and volume, for example the different areas of the pressure/volume characteristic correlate with the different work areas of the oil-separating apparatus.

Furthermore, it is advantageous if the oil separator has two springs, which load the poppet valve, wherein a first spring is prestressed in the closed state of the poppet valve and a second spring is only stressed from a certain opening path of the poppet valve. The three work areas of the oil separator can be achieved simply in this manner, namely in the first work area the poppet valve is closed, in the second work area the poppet valve is open and only loaded by the force of the first spring, and in the third work area, the poppet valve is loaded both by the force of the first spring and by the force of the second spring.

Furthermore, it is particularly advantageous if the impactor has a progressive spring, which loads the poppet valve and which has a spring constant which increases with increasing compression of the spring. In this manner, the behaviour of the oil separator can likewise be influenced in such a manner that when switching on the ejector pump, a larger pressure difference can be achieved, which enables a better oil separation rate.

An advantageous variant provides that the oil separator(s) is or are formed by an impactor and/or is or are formed by a cyclone. An impactor and a cyclone are both inertia-based oil separators, which achieve an improved separation rate in the event of an increased pressure difference between inlet and outlet. Thus, the effects of the ejector pump can be exploited optimally.

A further advantageous variant provides that the poppet valve is additionally loaded with a reference pressure, which loads the poppet valve in the closing direction. Also, it can also be achieved in this manner that the pressure difference between inlet and outlet of the oil separator is increased, in order to achieve a better oil separation.

It is beneficial if the oil separator has a membrane against which the reference pressure bears and by means of which the poppet valve of the oil separator is loaded. Thus, a force generated by the reference pressure can be applied to the poppet valve in a simple manner.

It is advantageous if the reference pressure is a boost pressure of the supercharging apparatus or an inlet-side pressure of the ejector pump. As a result, a higher differential pressure is also generated in the oil separator in the case of high power of the ejector pump in particular, so that the support of the ejector pump for the crankcase ventilation also leads to an increase of the oil separation rate in particular.

In the description and the attached claims, an inlet-side pressure of the ejector pump is understood to mean the pressure of the gas flow, which drives the ejector pump at the inlet of the ejector pump.

It is particularly advantageous if the reference pressure is an ambient pressure, particularly an atmospheric ambient pressure. The ambient pressure is essentially constant, so that an underpressure generated by the ejector pump, which prevails as counter-pressure to the reference pressure at the membrane, can influence the poppet valve. In particular, the underpressure is reduced in the event of increasing power of the ejector pump, so that less strong opening forces act on the poppet valve due to the underpressure. Consequently, in the case of an increased power of the ejector pump, the opening cross section of the oil separator is reduced, so that the pressure difference at the oil separator can increase and thus the oil separation is improved.

A particularly advantageous variant provides that the crankcase ventilation apparatus has a throttle valve, using which blow-by gases can be throttled. Should the underpressure generated by the ejector pump or the underpressure generated by the internal combustion engine become too large, so that the pressure inside the crankcase drops too far and there is a risk of evacuating oil from the crankcase, the throttle valve is closed, so that an evacuation of oil from the crankcase can be prevented.

A further particularly advantageous variant provides that the throttle valve is arranged in a flow path of the blow-by gases between the crankcase and the oil-separating apparatus, or that the throttle valve is arranged in a flow path of the blow-by gases between the oil-separating apparatus and the ejector pump. In both of these positions, the throttle valve can effectively prevent too-strong an evacuation of the blow-by gases.

Further important features and advantages of the invention result from the sub-claims, from the drawings and from the associated description of the figures on the basis of the drawings.

It is to be understood that the previously mentioned features and the features which are still to be mentioned in the following, can be used not only in the respectively specified combination, but also in other combinations or alone, without departing from the scope of the present invention.

Preferred exemplary embodiments of the invention are illustrated in the drawings and are described in more detail in the following description, wherein identical reference numbers refer to identical or similar or functionally identical components.

BRIEF DESCRIPTION OF THE DRAWINGS

In the figures, in each case schematically.

DETAILED DESCRIPTION

Figure 1:
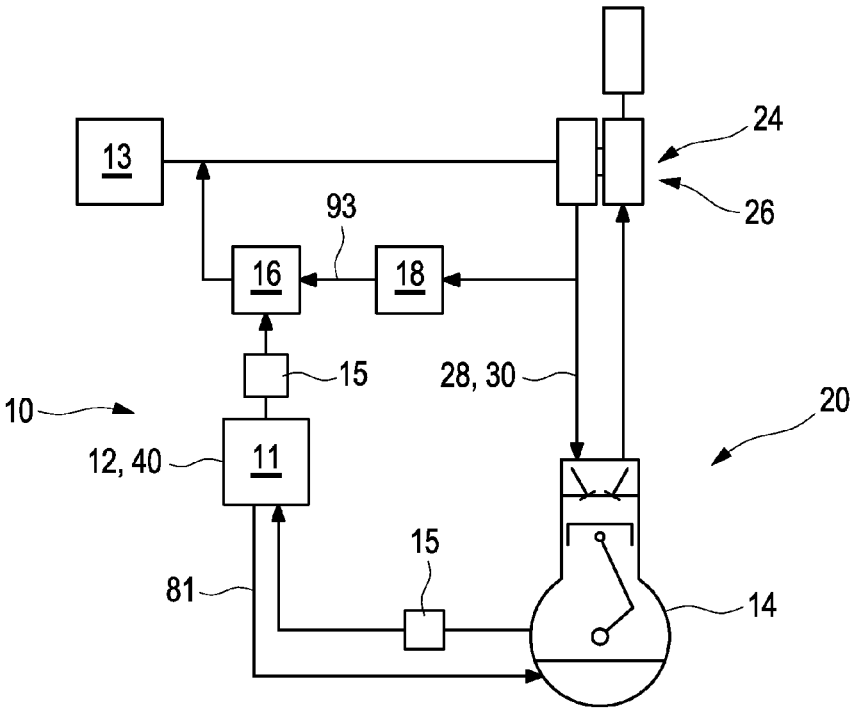
FIG. 1 shows a schematic sketch of an internal combustion engine with a crankcase ventilation apparatus.
Figure 2:
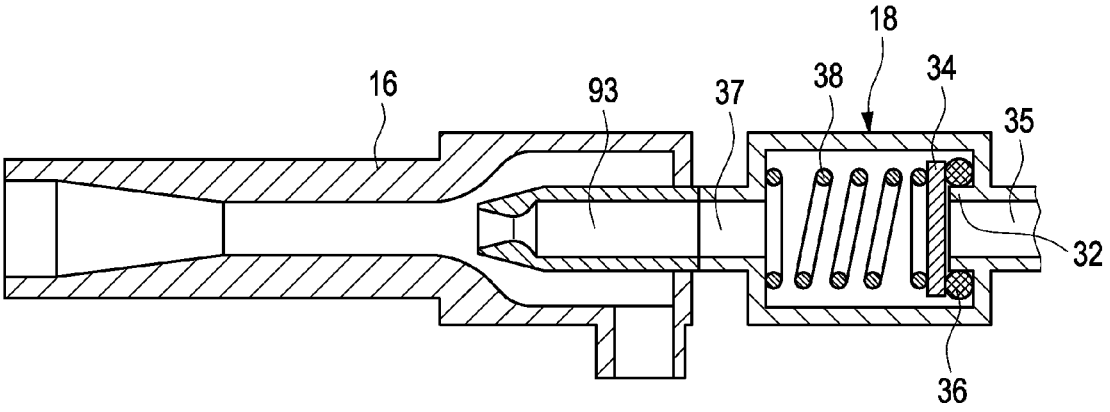
FIG. 2 shows a sectional illustration of an ejector pump with a pump control valve.
Figure 3:
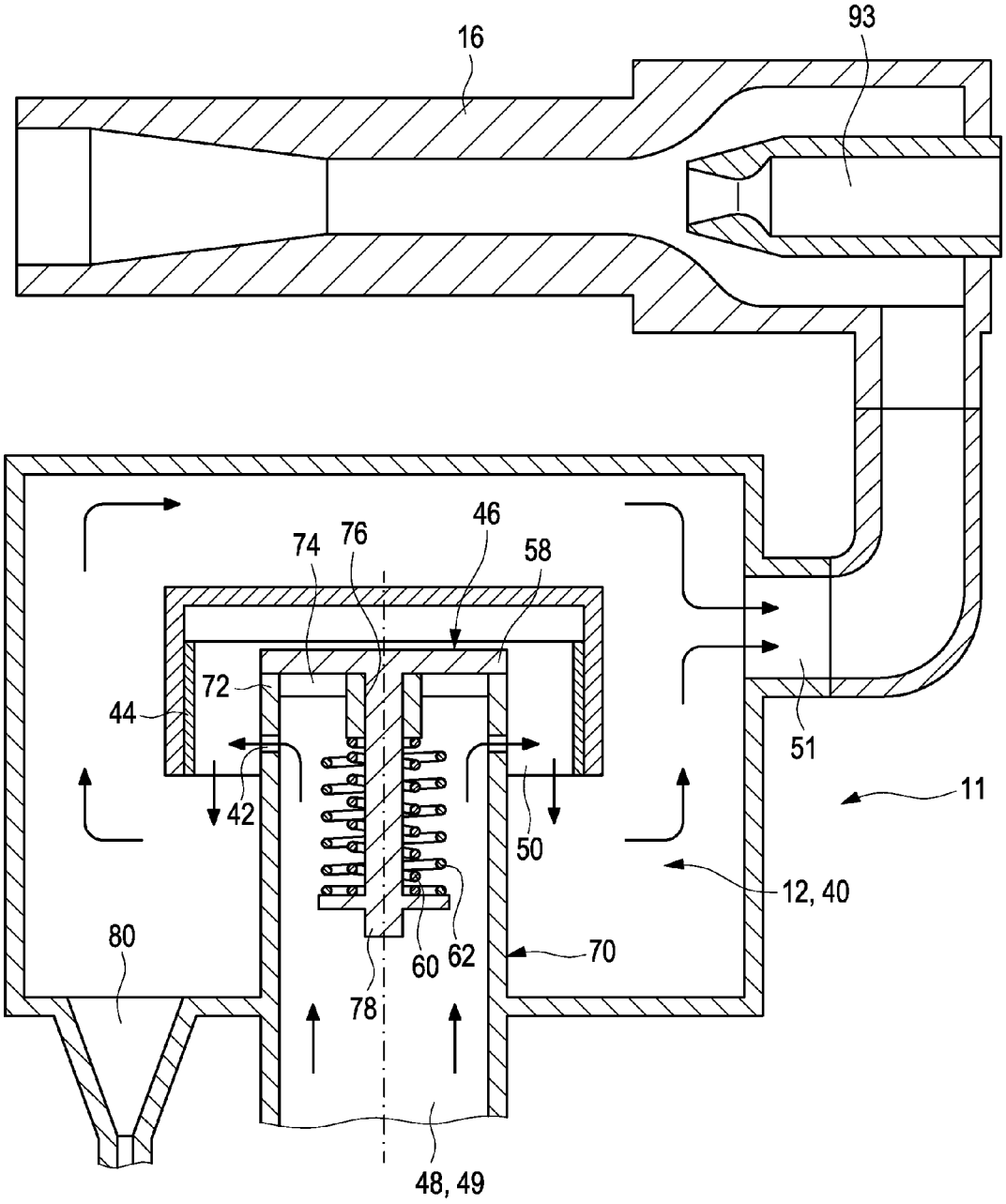
FIG. 3 shows a sectional illustration of an oil-separating apparatus with ejector pump connected thereto.
Figure 4:
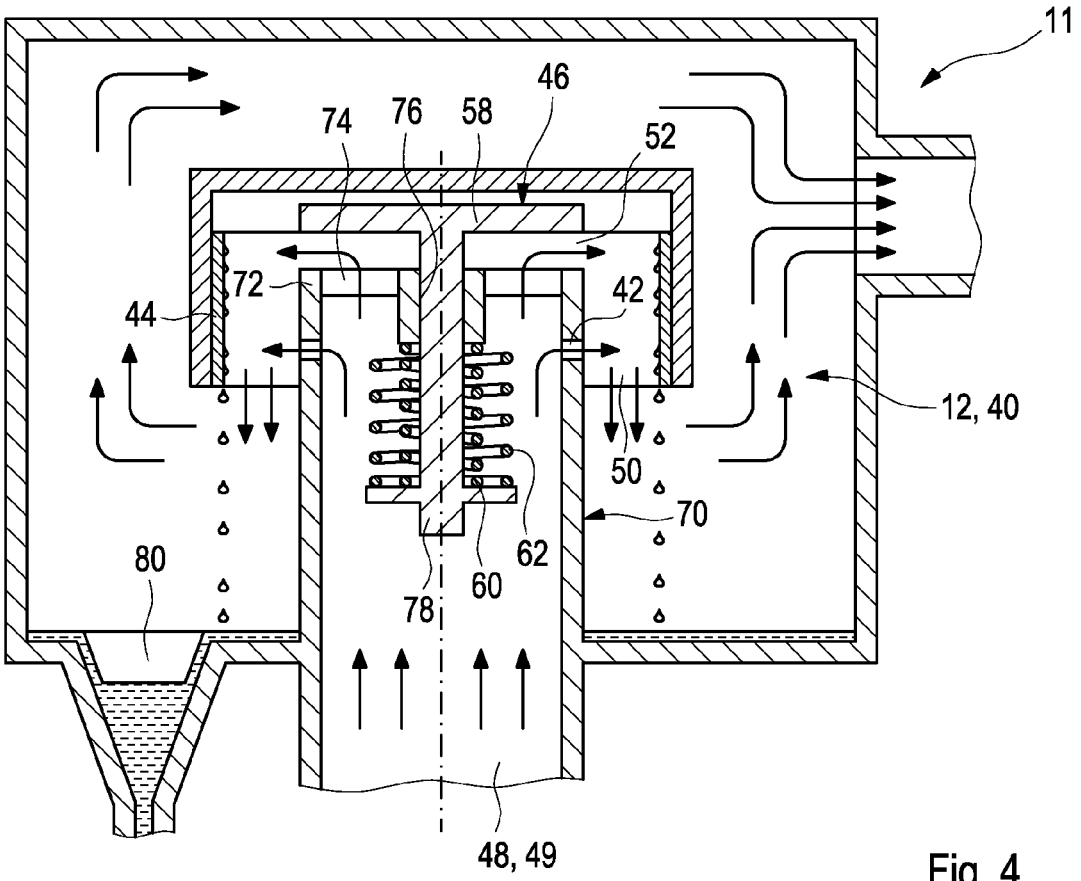
FIG. 4 shows a sectional illustration through the oil-separating apparatus, wherein a poppet valve of the oil-separating apparatus is partially open.
Figure 5:
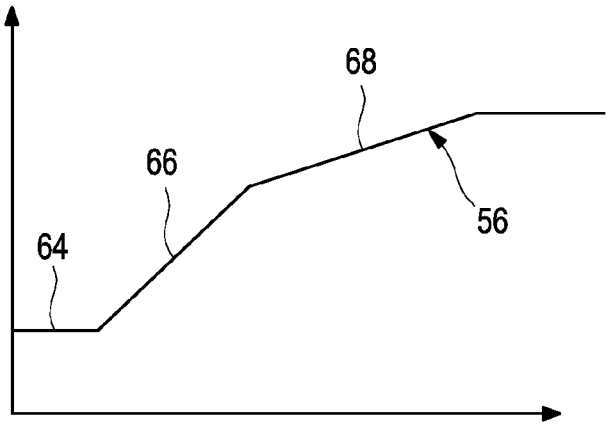
FIG. 5 shows a graph, wherein a flow cross section of the oil-separating apparatus is illustrated over a differential pressure between valve inlet and valve outlet of the poppet valve of the oil-separating apparatus.

A crankcase ventilation apparatus 10 illustrated in FIG. 1 has a liquid-separating apparatus 11, termed oil-separating apparatus 11 in the following, through which blow-by gases from a crankcase 14 are conveyed, in order to separate oil mist from the blow-by gas, an ejector pump 16, which generates an underpressure, in order to drive the blow-by gases, and a pump control valve 18, which controls and/or regulates the suction power of the ejector pump 16. The crankcase ventilation apparatus 10 is used for ventilating the crankcase 14 of an internal combustion engine 20, as it is used for example in a vehicle 22, particularly a motor vehicle.

In reciprocating engines, such as diesel engines for example, gases reach the crankcase 14 from the combustion chamber owing to the high pressure during the combustion. In this case, gases flow between piston and cylinder wall into the crankcase 14. These gases are termed blow-by gases. The blow-by gases would accumulate in the crankcase 14 over time and build a considerable pressure. In order to prevent this, the crankcase ventilation apparatus 10 is provided.

Because the blow-by gases that are ventilated from the crankcase 14 usually contain oil mist, the same are supplied to the intake tract 13 of the internal combustion engine 20. The oil-separating apparatus 11 is provided in order to not load the internal combustion engine 20 and units that may be located in the intake tract 13, such as supercharging apparatuses 24 for example, with the oil mist. The oil-separating apparatus 11 causes a pressure difference or requires a certain pressure difference, in order to achieve sufficiently high separation rates. For this reason, for example in the case of pure aspirating internal combustion engines, the underpressure in the intake tract 13 of the internal combustion engine 20 is exploited, in order to provide a pressure difference for the oil-separating apparatus 11. In the case of supercharged internal combustion engines, which have a compressor or a turbocharger 26 for example, the ejector pump 16 can be provided, which is driven by compressed air 28 generated by the supercharging apparatus 24, and generates an underpressure. Thus, a larger pressure difference can be generated between the crankcase 14 and the outlet of the oil-separating apparatus 11. As a result, a better separation rate can be achieved. This is interesting in particular, as a maximum permitted pressure in the crankcase 14 should not be exceeded, however.

The removal of the compressed air 28 downstream of the supercharging apparatus 24 leads to power losses of the internal combustion engine 20. When using a turbocharger 26 in particular, the responsiveness of the internal combustion engine 20 is impaired as a result, principally at low powers. Thus, for example during idling or in the partial load range, the turbocharger 26 is at a low rotational speed and thus generates only a small boost pressure 30. If, especially in such a situation, additional compressed air 28 should also be removed, in order to support the crankcase ventilation apparatus 10, the engine power is sharply reduced. In a higher load range or at full load, by contrast, the turbocharger 26 is at full rotational speed and can generate compressed air 28 satisfactorily and a satisfactorily high boost pressure 30, so that often a wastegate is even used, in order to prevent impermissible high rotational speeds of the turbocharger. In such situations, the removal of compressed air 28 is not damaging for the power of the internal combustion engine 20.

The pump control valve 18 is constructed in such a manner that the ejector pump 16 is operated if sufficient boost pressure 30, that is to say satisfactory quantities of compressed air 28, from the supercharging apparatus 24 are available. Accordingly, the power of the ejector pump 16 is throttled or the ejector pump 16 is switched off completely, if insufficient boost pressure 30 or compressed air 28 is available, for example during idling or in partial load ranges of the internal combustion engine 20.

Thus, the crankcase ventilation is supported by the ejector pump 16 just when the internal combustion engine 20 is outputting high power. That is to say just when a volumetric flow of the blow-by gases into the crankcase 14 is particularly high. Viewed the other way round, the throttling of the ejector pump 16 takes place just in operating states of the internal combustion engine 20 when relatively low quantities of blow-by gas are reaching the crankcase 14 anyway.

The pump control valve 18 is constructed in such a manner that the pump control valve 18 opens or closes depending on a pressure difference between a valve inlet 35 and a valve outlet 37. The pump control valve 18 is closed in the case of small pressure differences. In the case of pressure differences above a threshold pressure difference, the pump control valve 18 opens, so that gases can flow through the pump control valve. The pump control valve 18 is therefore an own-medium-actuated valve. As a result, no control line is required to control and/or regulate the pump control valve.

In the description and the attached claims, an own-medium-actuated valve is understood to mean a valve in which the medium to be controlled is the same medium as the medium controlling the valve. Examples for own-medium-actuated valves are non-return valves and pressure-relief valves.

At the inlet side, the pump control valve 18 is connected at the high-pressure side of the supercharging apparatus 24, so that the boost pressure 30 of the supercharging apparatus 24 bears against the pump control valve 18 at the inlet side. The pump control valve 18 therefore opens when the boost pressure 30 of the supercharging apparatus 24 exceeds the output-side pressure of the pump control valve 18, that is to say the pressure at the inlet of the ejector pump 16, by more than the threshold pressure difference. Thus, the pump control valve 18 opens when it is not damaging for the power of the internal combustion engine 20 if compressed air 28 is used for driving the ejector pump 16.

Alternatively or in addition thereto, it can be provided that the pump control valve 18 is constructed in such a manner that it opens or closes depending on the inlet-side pressure. At low pressures up to a threshold pressure, the pump control valve 18 is closed. At pressures above the threshold pressure, the pump control valve 18 opens, so that gases can pass through the pump control valve 18.

At the inlet side, the pump control valve 18 is connected at the high-pressure side of the supercharging apparatus 24, so that the boost pressure 30 of the supercharging apparatus 24 bears against the pump control valve 18 at the inlet side. The pump control valve 18 therefore opens if the boost pressure 30 of the supercharging apparatus 24 lies above the threshold pressure. Thus, the pump control valve 18 opens when it is not damaging for the power of the internal combustion engine 20 if compressed air 28 is used for driving the ejector pump 16.

The pump control valve 18 has a valve seat 32 and a closure part 34, which is pressed against the valve seat 32 in a force-loaded manner and thus closes the pump control valve 18. A seal 36 is arranged on the valve seat 32, against which the closure part 34 is pressed, and thus closes the pump control valve 18.

The closure part 34 is arranged in such a manner that the inlet-side pressure exerts a force on the closure part 34, which lifts the closure part 34 from the valve seat 32. The force with which the closure part 34 is loaded against the valve seat 32 and pressure force due to the boost pressure 30 therefore compete with one another. When the pressure force of the boost pressure 30 exceeds the force, with which the closure part 34 is loaded against the valve seat 32, the closure part 34 is lifted out of the valve seat 32, so that the pump control valve 18 opens. At the threshold pressure, at which the pump control valve 18 opens, the pressure force due to the boost pressure 30 is approximately equal to the force, with which the closure part 34 is loaded against the valve seat 32.

A plurality of options come into question for generating the force, with which the closure part 34 is loaded against the valve seat 32. For example, a spring 38 can be provided, which is prestressed, so that the closure part 34 is loaded against the valve seat 32 by the spring force of the spring 38.

Furthermore, it is also possible to exploit magnetically or pneumatically generated forces.

The ejector pump 16 is based on the Venturi effect. A first medium is conveyed through a nozzle and conveyed into a larger pipe. Due to the high flow speed of the medium at the nozzle, the surrounding medium is entrained, so that an underpressure arises there, which is exploited here in order to achieve a satisfactory pressure difference at the oil-separating apparatus 11.

The oil-separating apparatus 11 has an oil separator 12, which is an inertia-based oil separator. An inertia-based oil separator of this type is also suitable for separating other liquids, such as water for example. The oil separator 12 exploits the different densities of the oil droplets compared to the density of the blow-by gas, in order to separate the oil droplets from the blow-by gas. Usually, a gas flow is generated, which is diverted. The oil droplets cannot follow the diversion so well owing to the higher density, so that they are driven to the edge of the flow and may impact on a plate, on which they accumulate. Such inertia-based oil separators 12 are impactors 40 or cyclones for example.

The oil separator 12 is constructed as an impactor 40 and can also separate other liquids. In the case of an impactor 40, the gas flow to be cleaned, for example the blow-by gas, is conveyed through at least one nozzle 42, which is arranged opposite a deflector plate 44, so that the gas flow is diverted directly downstream of the nozzle. Due to the nozzle 42, the gas flow obtains a high speed, so that the liquid droplets, termed oil droplets in the following, cannot follow the diversion due to the deflector plate and impact against the deflector plate 44 and are caught there and thus are separated from the gas flow.

Furthermore, the impactor 40 has a poppet valve 46, which is closed in a spring-loaded manner, wherein the poppet valve 46 opens when a pressure difference between valve inlet 48 and valve outlet 50 is exceeded, which corresponds to a pressure difference between inlet 49 and outlet 51 of the oil-separating apparatus 11. In this case, the poppet valve 46 forms an annular flow gap 52, which likewise functions like a nozzle, and the gas flow flowing through the impactor 40 accelerates the blow-by gas for example. The annular flow gap 52 is surrounded by a cylindrical deflector plate 44, which diverts the gas flow, which is being streamed through the annular flow gap 52, and therefore also allows a separation of oil droplets from the gas flow there. Because the poppet valve 46 opens in the event of an increasing pressure difference, a flow cross section 56 of the impactor 40 is enlarged and therefore the flow cross section of the oil-separating apparatus 11 is enlarged. The flow cross section 56 is in this case composed of the cross section of all nozzles 42 and the flow area of the annular flow gap 52.

Because the flow cross section 56 of the impactor 40 is increased from a certain pressure difference threshold, the pressure drop increases within the impactor less sharply with the increase of the volumetric flow starting from a certain pressure. As a result, it can be achieved that as early as possible, that is to say also at low volumetric flows of the blow-by gases, a sufficiently high differential pressure for the oil separation prevails at the impactor 40 and at the same time, the differential pressure does not increase so sharply that the ventilation of the crankcase 14 can no longer be guaranteed.

Due to the support of the ejector pump 16, larger pressure differences at the impactor 40 can also be accepted in the case of the crankcase ventilation apparatus 10 according to the invention, however. For this reason, the poppet valve 46 is constructed in such a manner that the poppet valve 46 can be opened more easily over a first opening path than over a residual opening path. This is achieved for example in that the poppet valve 46 has two springs, which press a closure poppet 58 against a valve seat, wherein a first spring 60 is prestressed and a second spring 62 is not prestressed when the poppet valve is closed. The second spring 62 is only stressed when the poppet valve 46 opens if the first opening path of the poppet valve 46 has been passed through. In this manner, the spring constant, which is relevant for the poppet valve 46, is lower in the first opening path than in the residual opening path, as the spring constants of the first spring 60 and the second spring 62 are added.

This means that the impactor 40 has three work areas. In a first work area 64, the poppet valve 46 is closed and the gas flow must flow through the nozzles 42. In a second work area 66, the poppet valve 46 is partially open, wherein only the first spring 60 is stressed, so that the poppet valve 46 can open against a small spring constant. In a third work area 68, the poppet valve 46 is open so wide that both the first spring 60 and the second spring 62 are stressed, so that a further opening of the poppet valve 46 must take place against an increased spring force.

The work areas are preferably selected in such a manner that when the ejector pump 16 is switched off or operates at very low power, the impactor 40 operates in the first work area or in the second work areas 66 and if the ejector pump 16 is switched on, the impactor 40 operates in the third work area 68.

The impactor 40 has an inlet-side inner cylinder 70, in which the nozzles 42 are arranged in the cylinder wall at a head end 72 of the inner cylinder 70 and are radially outwardly directed. Arranged at the head end 72 are, on the one hand, flow openings 74 for the poppet valve 46, by means of which the gas flow can flow through the poppet valve 46, and on the other hand, a central bore 76, in which a guide pin 78 of the poppet valve 46 is guided, so that a closure poppet 58 is mounted in an axially movable manner in the inner cylinder 70.

The closure poppet 58 bears from the outside against the head end 72 of the inner cylinder 70 and thus closes the flow openings 74 when the poppet valve 46 is closed. The closure poppet 58 is axially lifted from the head end 72 of the inner cylinder 70 in order to expose the flow opening 74, when the poppet valve 46 is open.

An annular plate element is fastened on the guide pin 78 at the end facing away from the closure poppet 58, against which plate element the springs 60, 62 can act, in order to press the closure poppet 58 against the flow openings 74.

The springs 62, 60 are supported in this case on an inner side of the inner cylinder 70 at the head end 72 of the inner cylinder 70 and therefore push the plate-shaped closure part 58 in the direction of the valve inlet 48. The deflector plate 44 is cylindrically constructed and arranged radially outside the inner cylinder and can therefore divert the gas flow, which flows through the nozzles 42 or through the annular flow gap 52, and thus separate liquid, for example oil, from the gas flow.

Furthermore, the impactor 40 has a liquid accumulation area 80, in which the separated liquid, for example oil, is collected, in order to then be able to return it via an oil return 81 to the crankcase 14.

A throttle valve 15 is fluidically arranged between the crankcase 14 and the impactor 40, which can throttle the flow of the blow-by gases, in the event that the pressure in the crankcase 14 should fall too sharply, so that oil would be sucked out of the crankcase 14. Alternatively or additionally to this, the throttle valve 15 can also be arranged fluidically between the oil-separating apparatus and the ejector pump 16.

Figure 6:
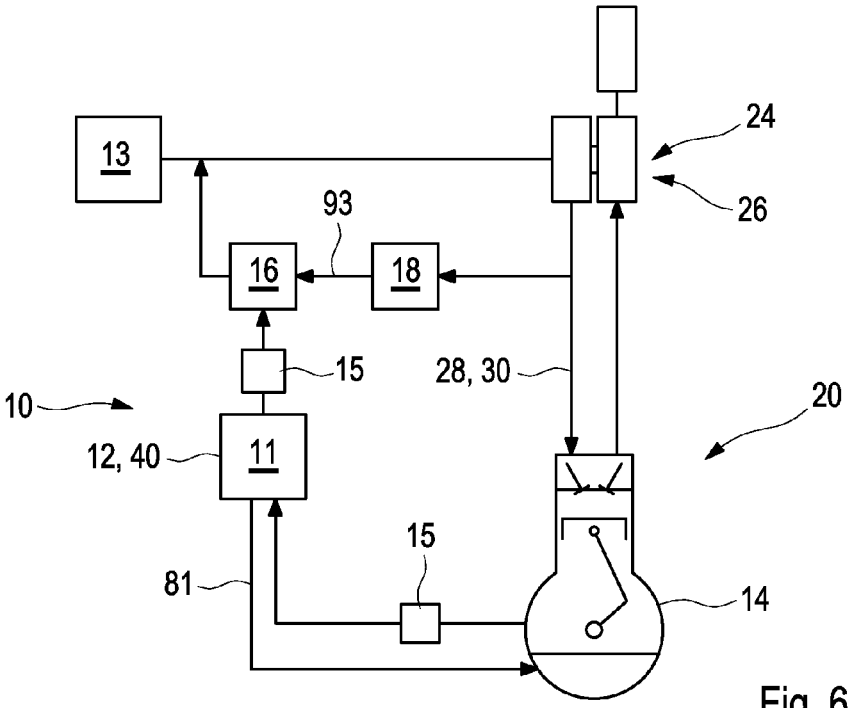
FIG. 6 shows a schematic sketch of an internal combustion engine with a crankcase ventilation apparatus according to a second embodiment of the invention.
Figure 7:
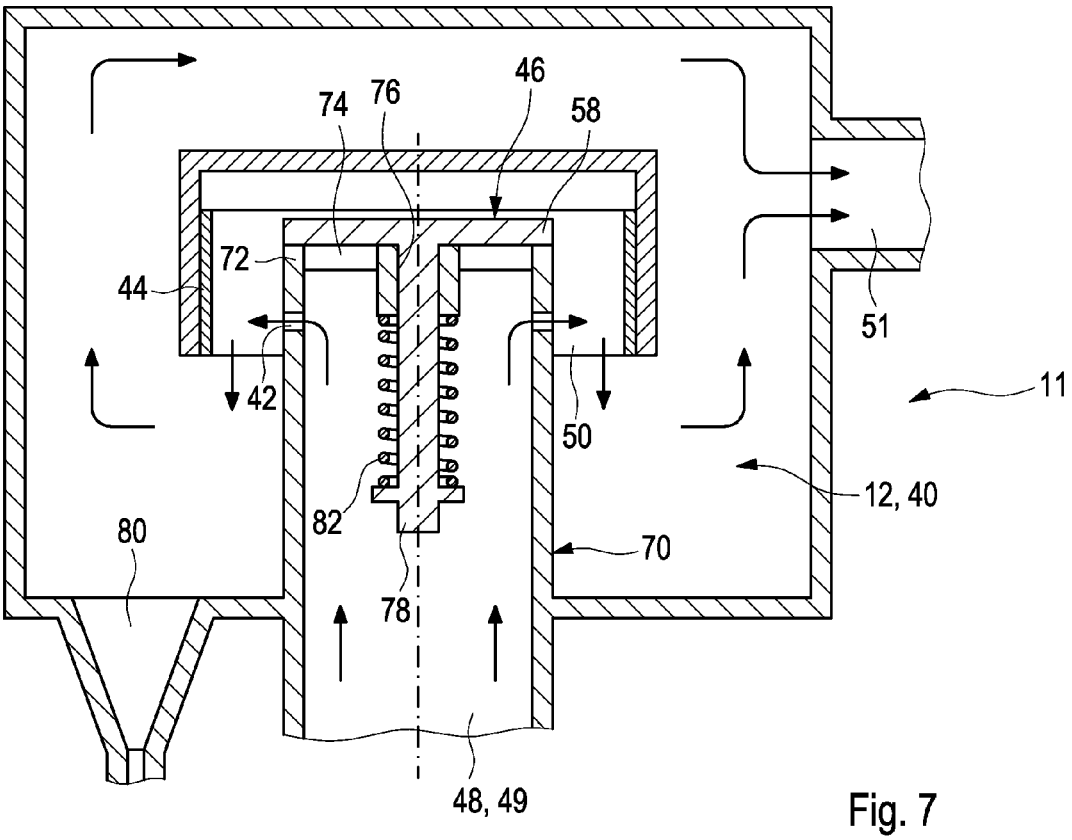
FIG. 7 shows a sectional illustration through an oil-separating apparatus according to the second embodiment.
Figure 8:
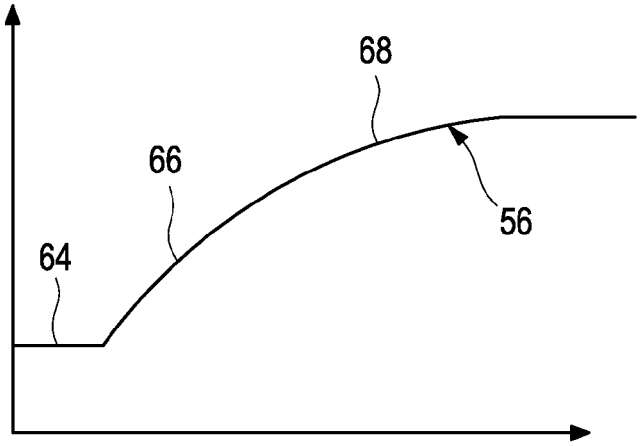
FIG. 8 shows a graph, wherein the flow cross section of the oil-separating apparatus is illustrated against a pressure difference between valve inlet and valve outlet of the poppet valve of the oil-separating apparatus.

A second embodiment of the crankcase ventilation apparatus 10 illustrated in FIGS. 6 to 8 differs from the first embodiment of the crankcase ventilation apparatus 10 illustrated in FIGS. 1 to 5 in that the poppet valve 46 of the impactor 40 has a progressive spring 82, using which the poppet-shaped closure part 58 of the poppet valve 46 is force-loaded against the flow openings 74.

In this manner, the second work area 66 and the third work area 68 of the impactor 40 merge into one another continuously, so that an increased pressure difference can be achieved at the impactor 40 by switching on the ejector pump 16.

Otherwise, with regards to design and function, the second embodiment illustrated in FIGS. 6 to 8 matches the first embodiment of the crankcase ventilation apparatus 10 illustrated in FIGS. 1 to 5, and reference is made to the preceding description thereof in this respect.

Figure 9:
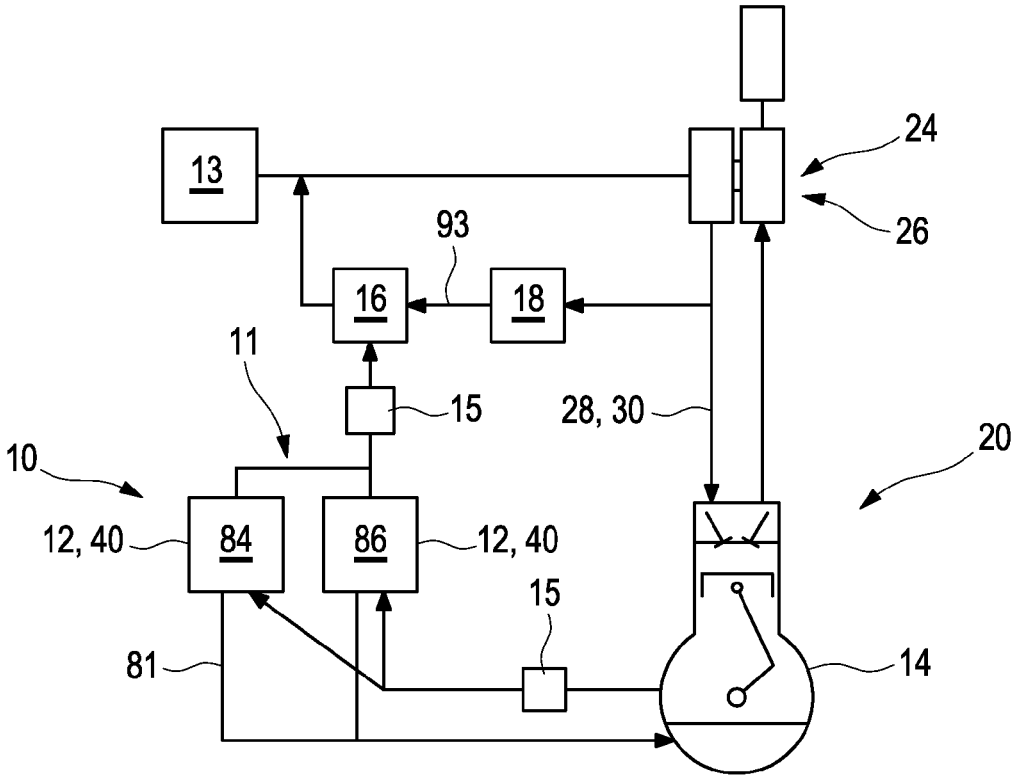
FIG. 9 shows a schematic illustration of an internal combustion engine with a crankcase ventilation apparatus according to a third exemplary embodiment.
Figure 10:
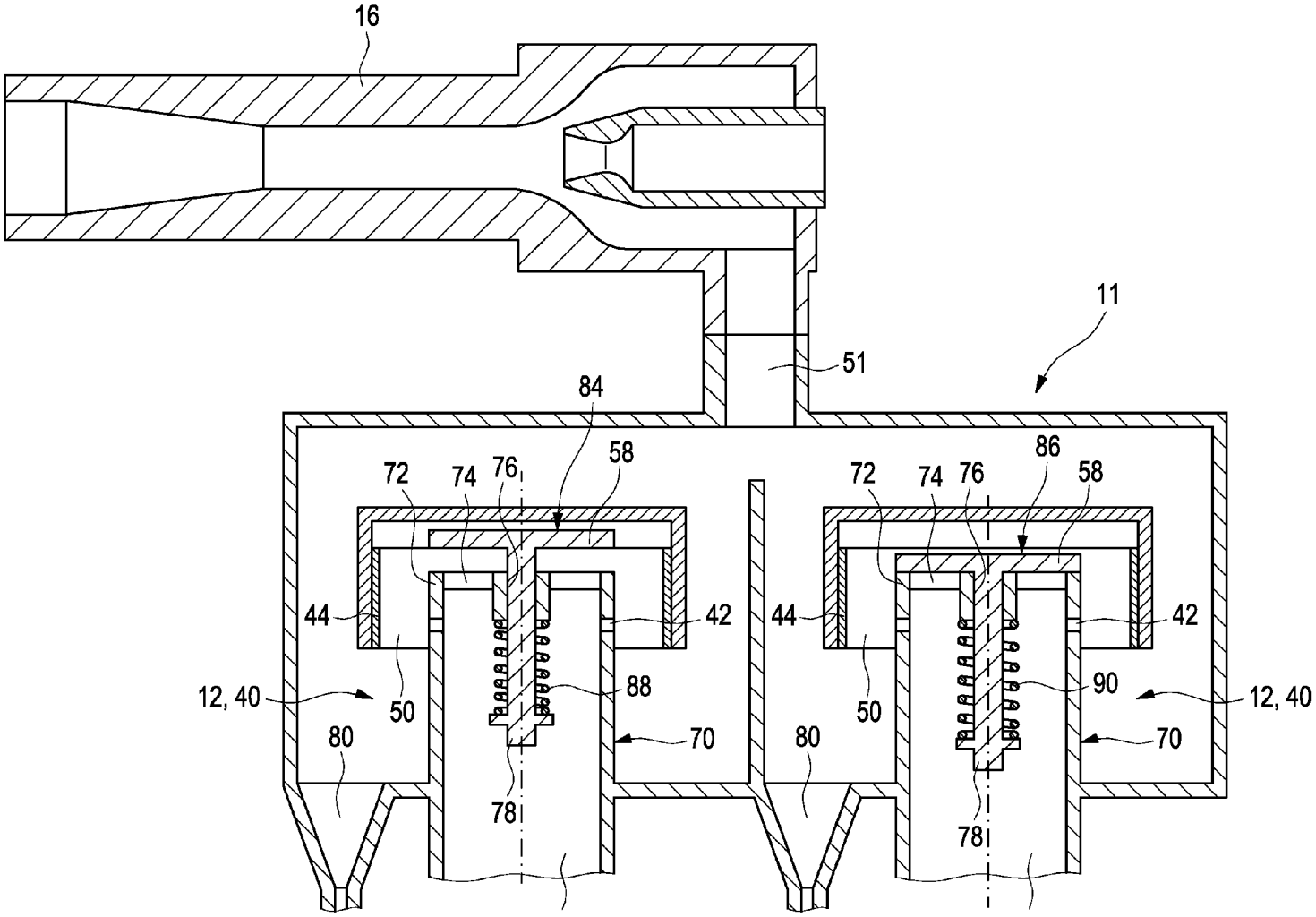
FIG. 10 shows a sectional illustration through an oil-separating apparatus, with ejector pump connected thereto, according to the third embodiment.

A third embodiment of the crankcase ventilation apparatus 10 illustrated in FIGS. 9 to 10 differs from the first embodiment of the crankcase ventilation apparatus 10 illustrated in FIGS. 1 to 5 in that the oil-separating apparatus 11 has two oil separators 12, for example two impactors 40, by means of which the oil-separating apparatus 11 has a plurality, for example three work areas.

The oil-separating apparatus 11 has a first poppet valve 84 and a second poppet valve 86, wherein both poppet valves have only one spring in each case. Wherein the spring 88 of the first poppet valve 84 has a lower spring constant than the spring 90 of the second poppet valve 86. Furthermore, the prestress of the spring 90 of the second poppet valve 86 is such that the second poppet valve 86 only opens when the first poppet valve 84 is already maximally open. The first poppet valve 84 is also termed the low-pressure poppet valve 84 and the second poppet valve 86 is also termed the high-pressure poppet valve 86.

The first work area 64 of the oil-separating apparatus 11 is created in this manner, in which both the first poppet valve 84 and the second poppet valve 86 are closed, and the gas flow flowing through the oil-separating apparatus 11 can only flow through the nozzles 42. Furthermore, the second work area 66 is characterised in that the first poppet valve 84 is partially open and the second poppet valve 86 is closed. The third work area 68 is characterised in that the first poppet valve 84 is completely open and in that the second poppet valve is at least partially open. As a result, the same behaviour of the oil-separating apparatus 11 can be achieved as in the first two embodiments.

Otherwise, with regards to design and function, the third embodiment of the crankcase ventilation apparatus 10 illustrated in FIGS. 9 to 10 matches the first embodiment of the crankcase ventilation apparatus 10 illustrated in FIGS. 1 to 5, and reference is made to the preceding description thereof in this respect.

Figure 11:
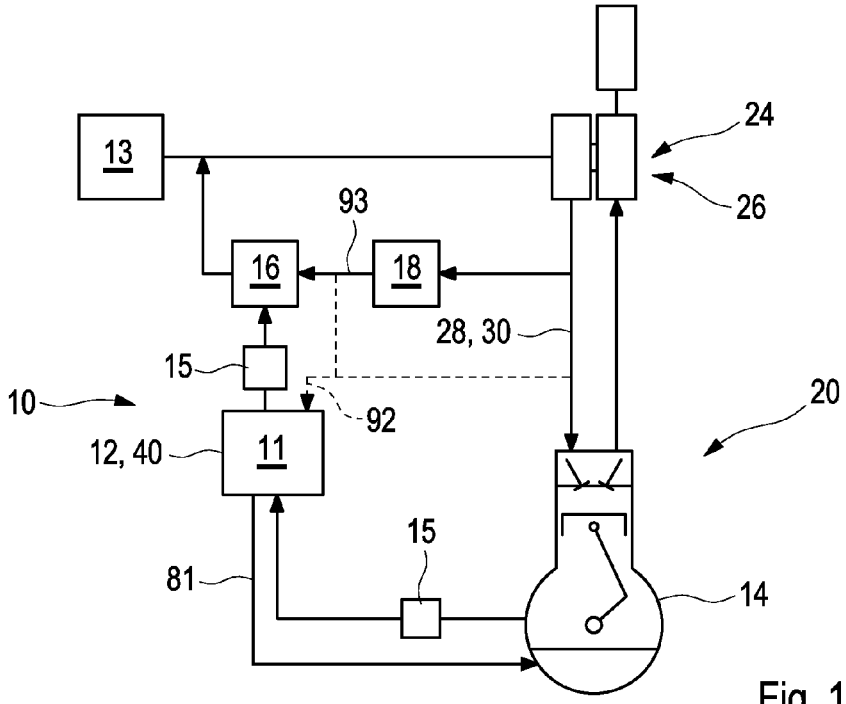
FIG. 11 shows a schematic sketch of an internal combustion engine with a crankcase ventilation apparatus according to a fourth embodiment.
Figure 12:
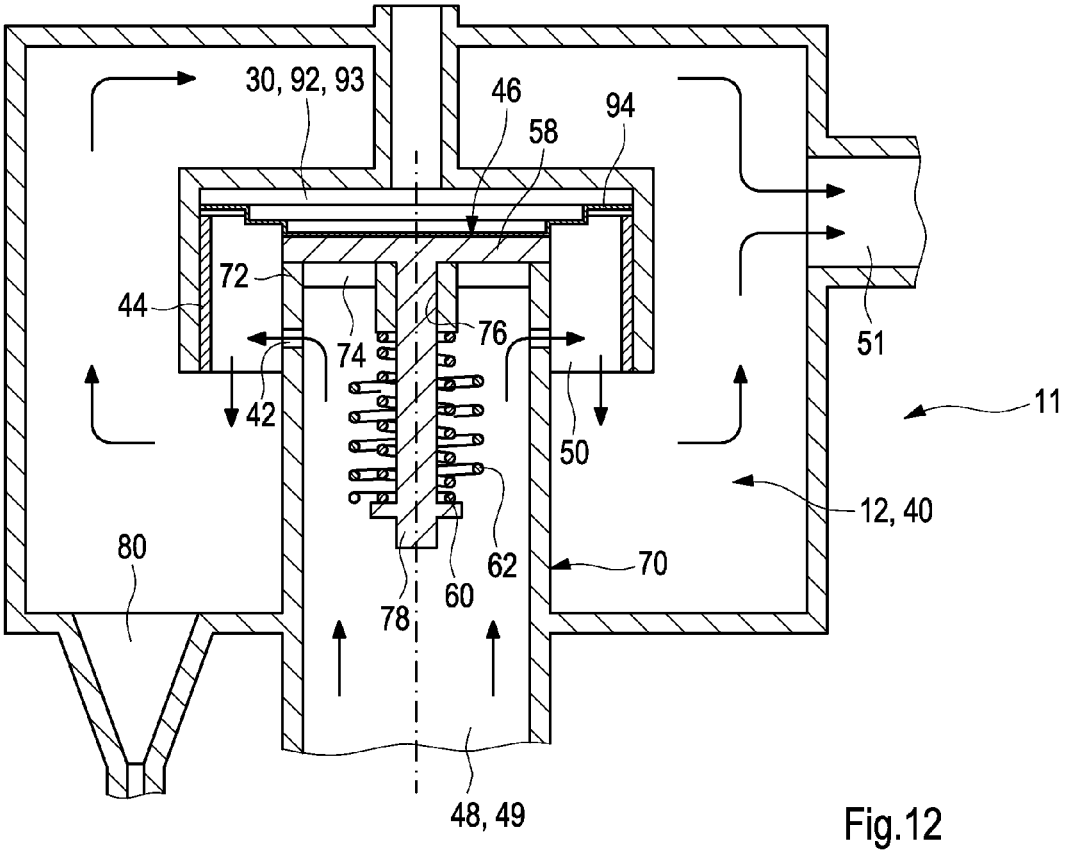
FIG. 12 shows a sectional illustration through an oil-separating apparatus according to the fourth embodiment.

A fourth embodiment of the crankcase ventilation apparatus 10 illustrated in FIGS. 11 and 12 differs from the first embodiment of the crankcase ventilation apparatus 10 illustrated in FIGS. 1 to 5 in that the poppet valve 46 is additionally loaded with a reference pressure 92, which presses the poppet valve 46 into a closed position.

The boost pressure 30 of the supercharging apparatus 24 can for example be used as reference pressure 92. At high boost pressures 30, the suction power of the ejector pump 16 is particularly high, so that a high pressure difference can be provided to the oil-separating apparatus 11 for the oil separation. In order to exploit this optimally, the flow cross section 56 of the oil-separating apparatus 11 must not be too large. This is achieved by means of the reference pressure 92, as at larger boost pressures 30, the poppet valve 46 is pushed closed again under certain circumstances, so that the flow cross section 56 of the oil-separating apparatus 11 increases less sharply or even decreases.

Alternatively, it can be provided that an inlet-side pressure 93 of the ejector pump 16 is used as reference pressure 92. When regulating the power of the ejector pump 16 by means of the pump control valve 18, the inlet-side pressure 93 of the ejector pump 16 is also a measure for the power of the ejector pump 16, so that the adaptation of the oil-separating apparatus 11 is adapted particularly beneficially to the suction power of the ejector pump 16 that is actually available.

Furthermore, it can alternatively be provided that an atmospheric ambient pressure is used as reference pressure 92. The ambient pressure is essentially constant and is only subject to fluctuations owing to the height above zero and weather-related fluctuations.

In free space above the closure poppet 58 of the poppet valve 46, the impactor 40 has a pressure chamber closed by a membrane 94, in which the reference pressure 92 is introduced. The membrane 94 pushes, driven by the reference pressure 92, on the closure poppet 58. The closure poppet 58 is thereby additionally pressed onto the flow openings 74 of the poppet valve 46.

The pressure at the valve outlet 50 bears as counterpressure to the reference pressure 92 against the membrane 94, which thus loads the poppet valve 46 in the opening direction. The outlet 51 of the oil-separating apparatus 11 and therefore the valve outlet 51 is evacuated by the ejector pump 16, so that the underpressure generated by the ejector pump 16 prevails at the valve outlet 51. At high powers of the ejector pump 16, the pressure that opens the poppet valve 46 is therefore reduced, so that in the event of an increase in the power of the ejector pump 16, the poppet valve 46 is loaded more strongly in the closing direction. This applies also in the case of the use of an essentially constant pressure as reference pressure 92, such as atmospheric ambient pressure for example.

Furthermore, the pressure at the valve inlet 48 acts on the poppet valve 46 in the opening direction. The pressure at the valve inlet 48 is applied in particular at the underside of the poppet 58 and at the tip of the guide pin 78. The pressure at the valve inlet in this case essentially corresponds to the pressure in the crankcase 14.

Consequently, three competing pressures prevail at the poppet valve 46, namely the reference pressure, which loads the poppet valve 46 in the closing direction, the underpressure generated by the ejector pump 16 and the pressure in the crankcase, which load the poppet valve 46 in the opening direction.

Otherwise, with regards to design and function, the fourth embodiment of the crankcase ventilation apparatus 10 illustrated in FIGS. 11 and 12 matches the first embodiment of the crankcase ventilation apparatus 10 illustrated in FIGS. 1 to 5, and reference is made to the preceding description thereof in this respect.

Figure 13:
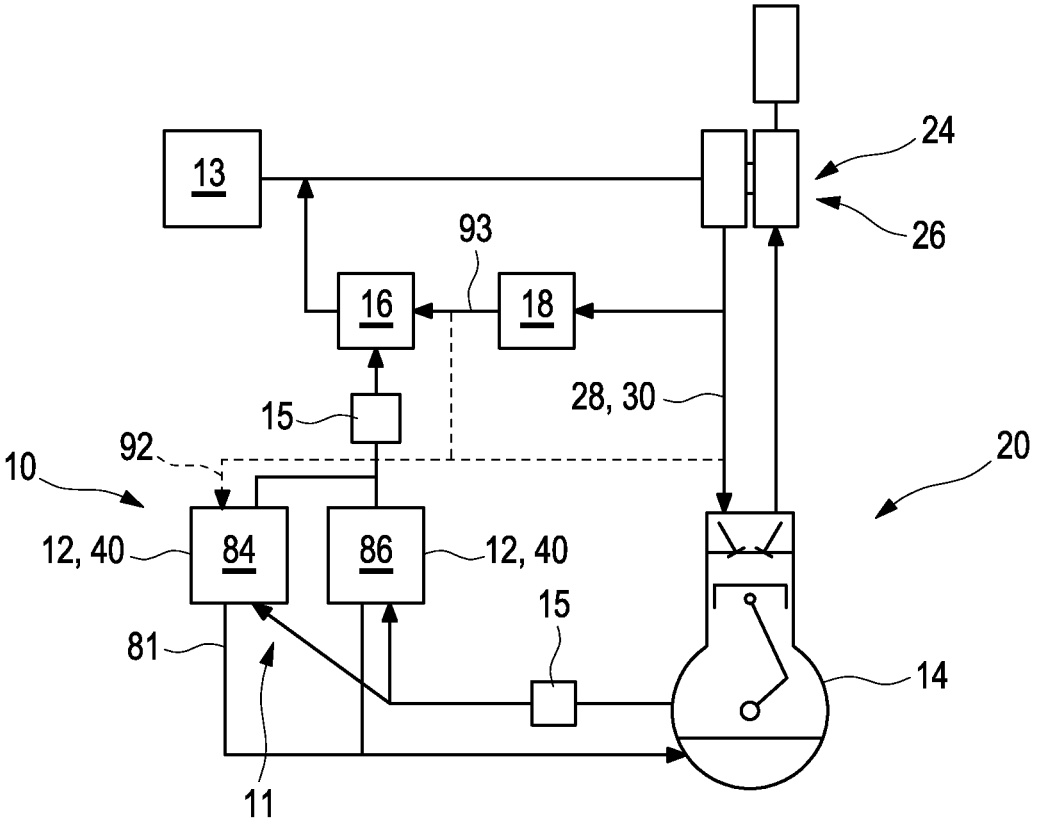
FIG. 13 shows a schematic sketch of an internal combustion engine with a crankcase ventilation apparatus according to a fifth embodiment.
Figure 14:
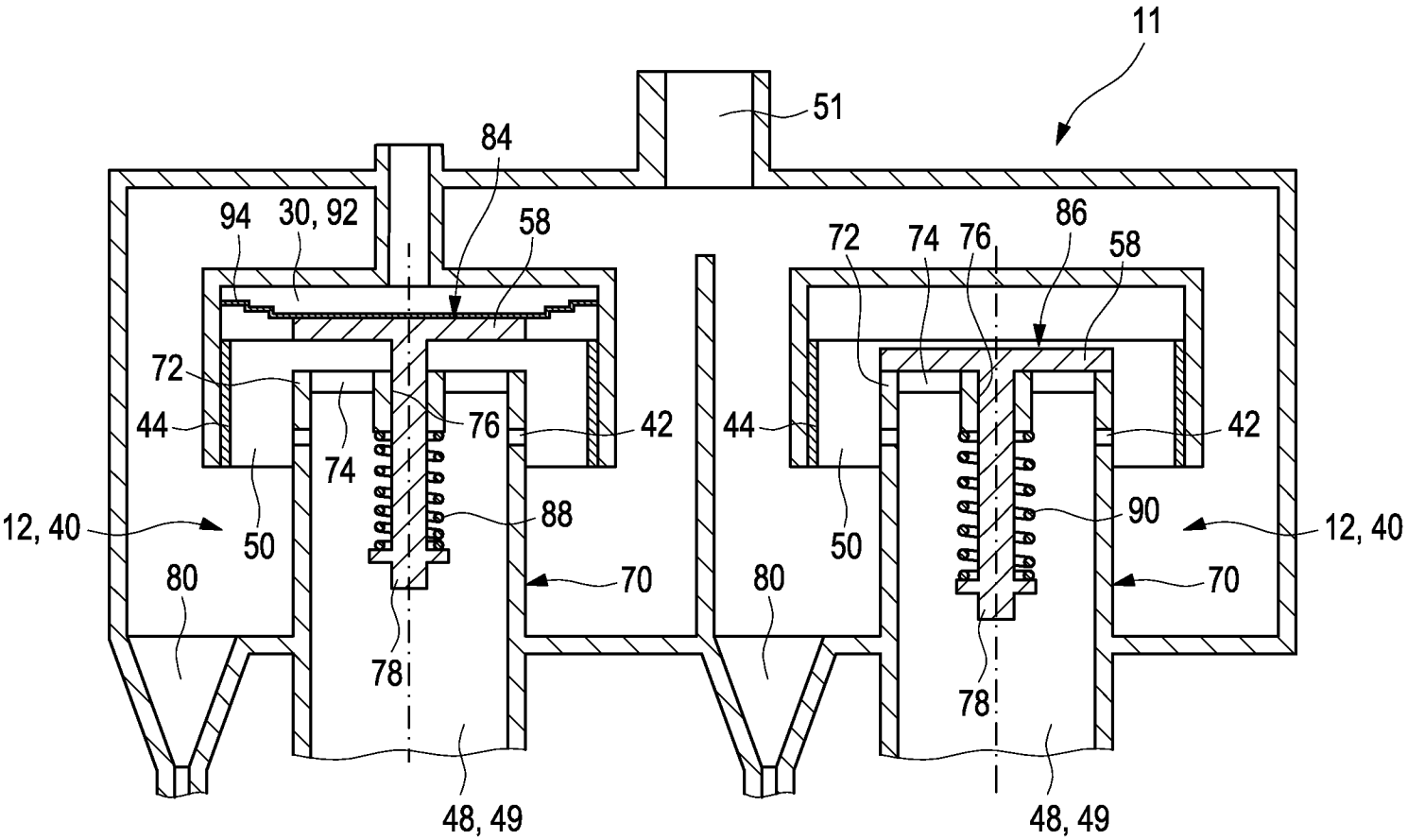
FIG. 14 shows a sectional illustration through an oil-separating apparatus according to the fifth embodiment.

A fifth embodiment of the crankcase ventilation apparatus 10 illustrated in FIGS. 13 and 14 differs from the third embodiment of the crankcase ventilation apparatus 10 illustrated in FIGS. 9 to 10 in that the first poppet valve 84, that is to say the low-pressure poppet valve 84, is additionally loaded with a reference pressure 92.

A switching of the oil-separating apparatus 11 from the first poppet valve 84 to the second poppet valve 86 can be achieved in this manner, for example. This switching can take place in accordance with the power of the ejector pump 16.

The boost pressure 30 of the supercharging apparatus 24 can for example be used as reference pressure 92. At high boost pressures 30, the first poppet valve 84, which is constructed as a low-pressure poppet valve 84, is pushed closed by means of the reference pressure 92, so that the low-pressure poppet valve 84 is opened less or is even closed. The liquid separation then mainly takes place by means of the high-pressure poppet valve 86.

An even higher pressure difference for the oil separation can be provided in this manner at the oil-separating apparatus 11 when the ejector pump 16 is switched on.

In free space above the closure poppet 58 of the poppet valve 84, the first poppet valve 84 has a pressure chamber closed by a membrane 94, in which the reference pressure 92 is introduced. The membrane 94 pushes, driven by the reference pressure 92, on the closure poppet 58. The closure poppet 58 is thereby additionally pressed onto the flow openings 74 of the poppet valve 84.

Otherwise, with regards to design and function, the fifth embodiment of the crankcase ventilation apparatus 10 illustrated in FIGS. 13 and 14 matches the third embodiment of the crankcase ventilation apparatus 10 illustrated in FIGS. 9 to 10, and reference is made to the preceding description thereof in this respect.

Figure 15:
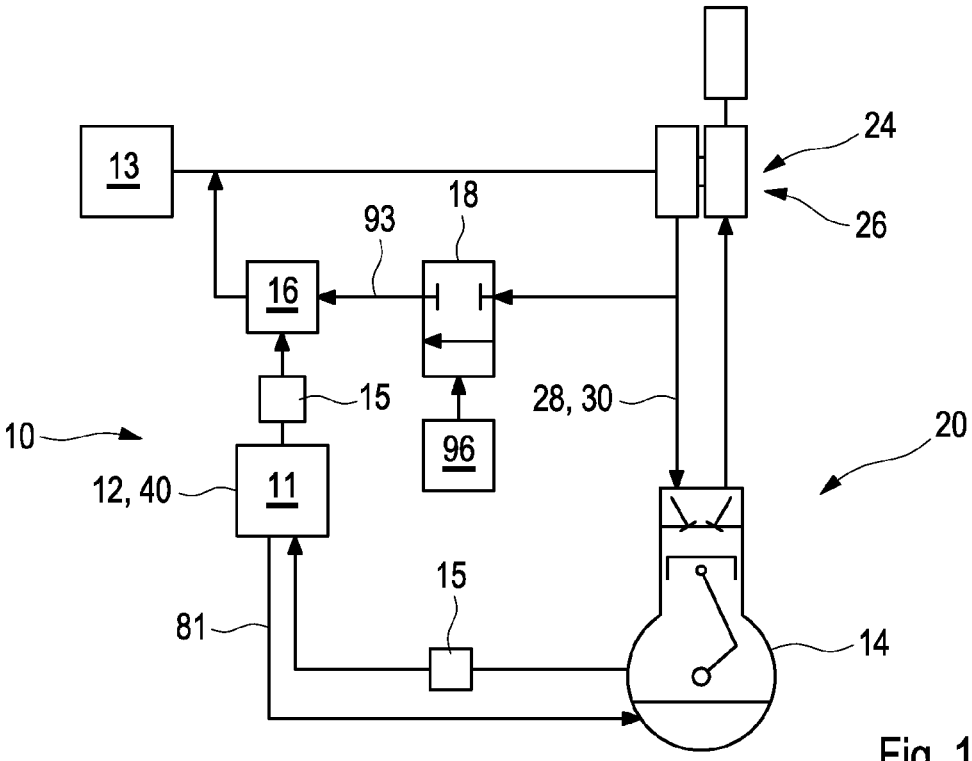
FIG. 15 shows a schematic sketch of an internal combustion engine with a crankcase ventilation apparatus according to a sixth embodiment of the invention.

A sixth embodiment of the crankcase ventilation apparatus 10 illustrated in FIG. 15 differs from the first embodiment of the crankcase ventilation apparatus 10 illustrated in FIGS. 1 to 5 in that the pump control valve 18 is controlled and/or regulated by means of a control apparatus 96.

The pump control valve 18 is correspondingly constructed to be controllable by means of a signal from outside. For example, the pump control valve 18 is an electrically, magnetically, pneumatically or hydraulically controllable valve. Preferably, the pump control valve 18 can be switched back and forth between a closed position and a passage position. However, it is also possible that the pump control valve 18 is a proportional valve, which can be adjusted continuously between the closed position and the passage position.

The control apparatus 96 controls the pump control valve 18 and therefore the power of the ejector pump 16 in such a manner that the responsiveness of the internal combustion engine 20 is influenced as little as possible. That is to say that the pump control valve 18 is closed in idling operation and/or partial load range in particular, so that the ejector pump 16 does not remove any compressed air 28 from the supercharging apparatus 24.

Different options are conceivable, on the basis of which the control apparatus 96 decides whether the ejector pump 16 is switched on or off. For example, the control apparatus can regulate and/or control the power of the ejector pump 16 in a map-based manner.

The control apparatus 96 is the engine control of the internal combustion engine 20 for example, so that the control apparatus 96 has access to all data from the engine control. In particular, these are the rotational speed of the internal combustion engine 20, the generated torque of the internal combustion engine 20, the generated power of the internal combustion engine 20 or a throttle position. On the basis of these values, the control apparatus 96 can estimate whether sufficient boost pressure 30 is present, so that the power of the internal combustion engine 20 is not influenced or only slightly influenced and whether supporting the crankcase ventilation by the ejector pump 16 is necessary.

Furthermore, the control apparatus 96 can regulate and/or control the ejector pump 16 according to a measured value. Such values can for example be the aspirated air quantity, the boost pressure 30 or the pressure in the crankcase 14. In this manner, the ejector pump can react to the conditions actually occurring in the crankcase 14 or downstream of the supercharging apparatus 24, and control the ejector pump 16 accordingly.

It is understood that a combination made up of map-based regulation and/or control and regulation and/or control on the basis of measured values is possible. For example, a value for the power of the ejector pump can be determined on the basis of the maps and if necessary adjusted on the basis of the measured value.

Otherwise, with regards to design and function, the sixth embodiment of the crankcase ventilation apparatus 10 illustrated in FIG. 15 matches the first embodiment of the crankcase ventilation apparatus 10 illustrated in FIGS. 1 to 5, and reference is made to the preceding description thereof in this respect.

Figure 16:
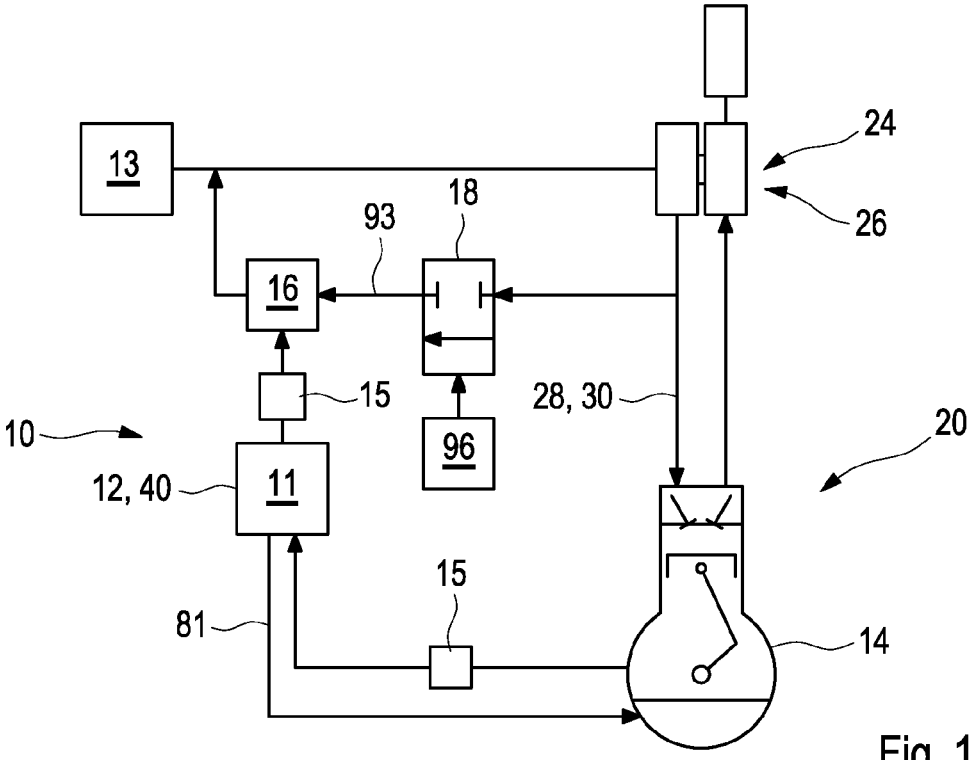
FIG. 16 shows a schematic sketch of an internal combustion engine with a crankcase ventilation apparatus according to a seventh embodiment.

A seventh embodiment of the crankcase ventilation apparatus 10 illustrated in FIG. 16 differs from the second embodiment of the crankcase ventilation apparatus 10 illustrated in FIGS. 6 to 8 in that the pump control valve 18 is controlled by means of a control apparatus 96. The regulation and/or control of the pump control valve 18 by the control apparatus 96 in this case corresponds to the regulation and/or control according to the sixth embodiment of the crankcase ventilation apparatus 10 illustrated in FIG. 15, and reference is made to the preceding description thereof in this respect.

Otherwise, with regards to design and function, the seventh embodiment of the crankcase ventilation apparatus 10 illustrated in FIG. 16 matches the second embodiment of the crankcase ventilation apparatus 10 illustrated in FIGS. 6 to 8 with regards to design and function, and reference is made to the preceding description thereof in this respect.

Figure 17:
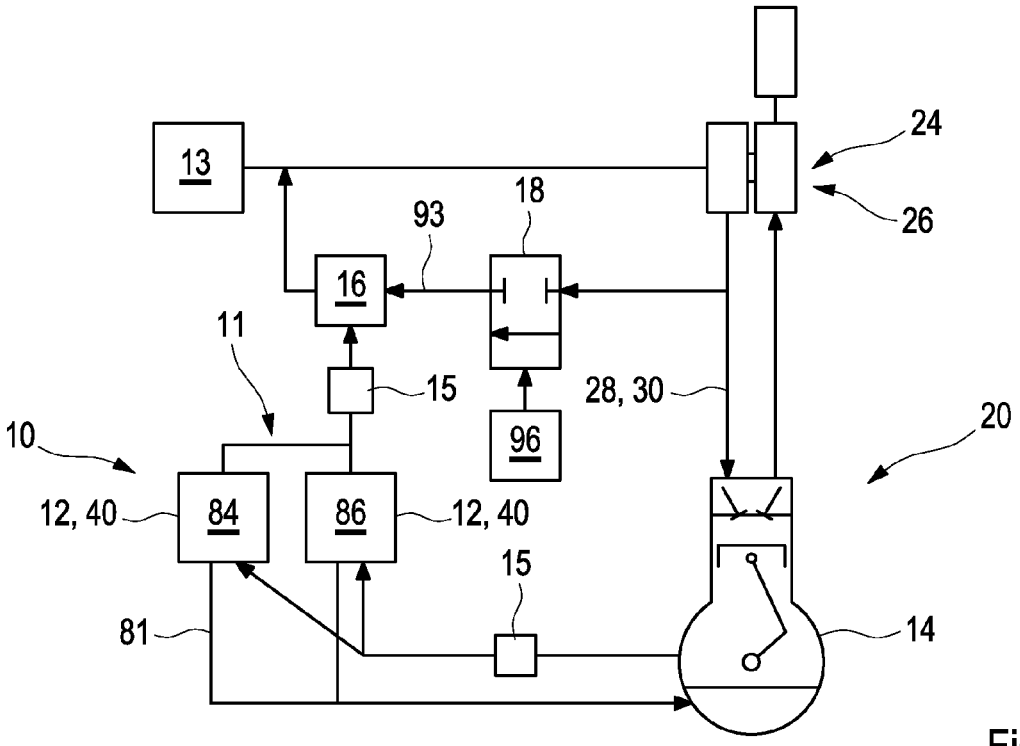
FIG. 17 shows a schematic sketch of an internal combustion engine with a crankcase ventilation apparatus according to an eighth embodiment.

An eighth embodiment of the crankcase ventilation apparatus 10 illustrated in FIG. 17 differs from the third embodiment of the crankcase ventilation apparatus 10 illustrated in FIGS. 9 to 10 in that the pump control valve 18 is regulated and/or controlled by means of a control apparatus 96. The regulation and/or control of the pump control valve 18 by the control apparatus 96 in this case corresponds to the regulation and/or control according to the sixth embodiment of the crankcase ventilation apparatus 10 illustrated in FIG. 15, and reference is made to the preceding description thereof in this respect.

Otherwise, with regards to design and function, the eighth embodiment of the crankcase ventilation apparatus 10 illustrated in FIG. 17 matches the third embodiment of the crankcase ventilation apparatus 10 illustrated in FIGS. 9 to 10, and reference is made to the preceding description thereof in this respect.

Figure 18:
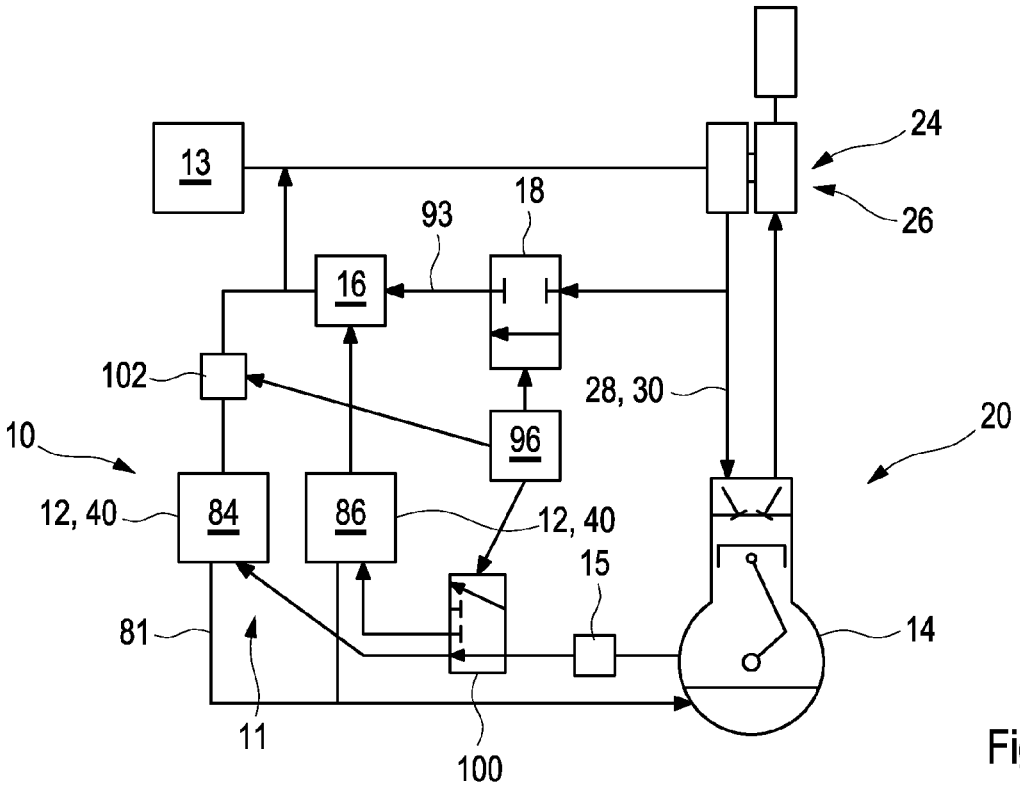
FIG. 18 shows a schematic sketch of an internal combustion engine with a crankcase ventilation apparatus according to a ninth embodiment.
Figure 19:
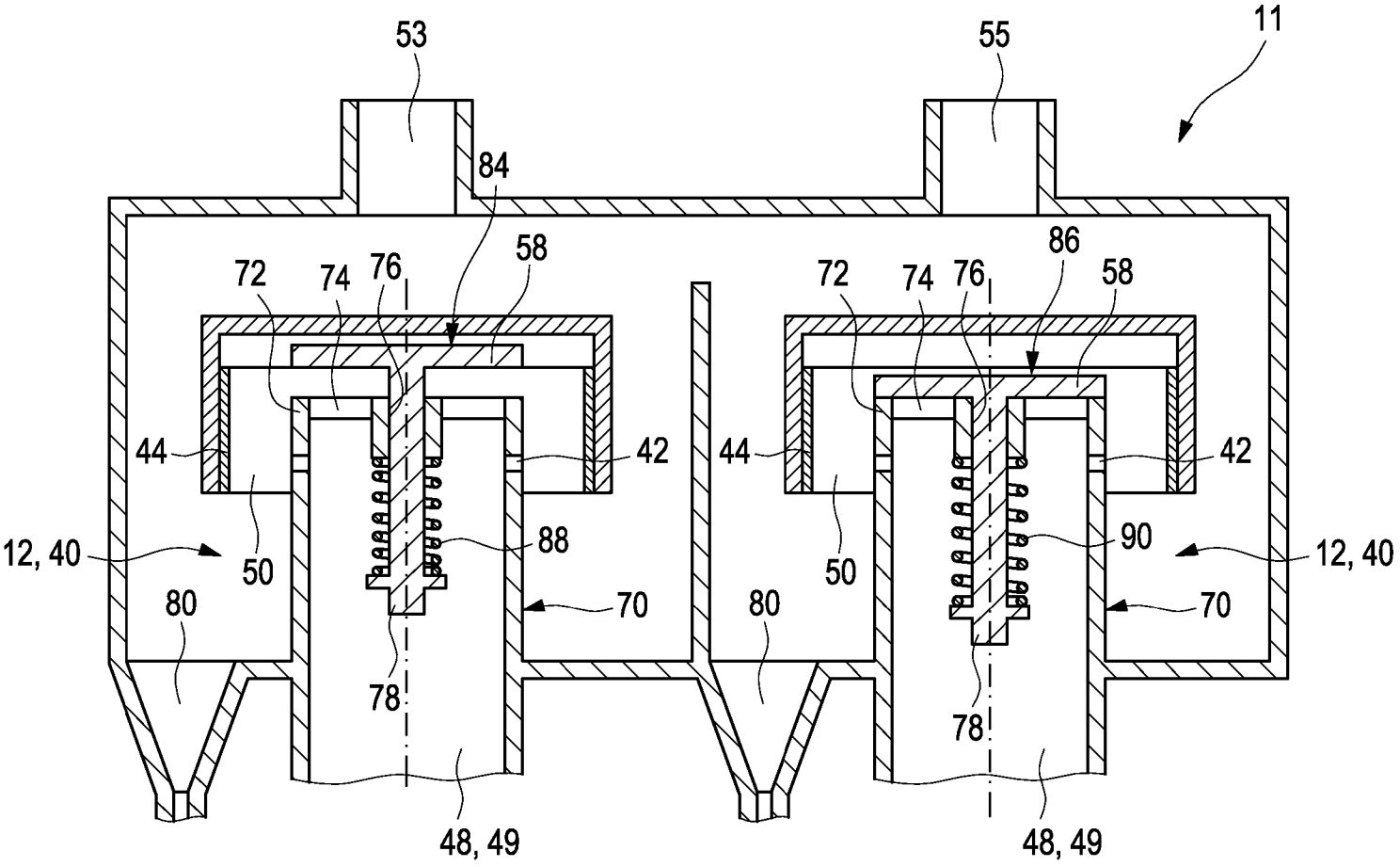
FIG. 19 shows a sectional illustration through an oil-separating apparatus according to the ninth embodiment.

A ninth embodiment of the crankcase ventilation apparatus 10 illustrated in FIGS. 18 to 19 differs from the eighth embodiment of the crankcase ventilation apparatus 10 illustrated in FIG. 17 in that the crankcase ventilation apparatus 10 has a switching valve 100, which switches the blow-by gas flow between the two impactors of the oil-separating apparatus 11. The switching valve 100 is controlled by the control apparatus 96. The control apparatus 96 switches the switching valve 100 in accordance with the fact that flow passes through the impactor 40 with the low-pressure poppet valve 84 if the ejector pump 16 is switched off or only operates at very low power, and that flow passes through the high-pressure poppet valve 86 if the ejector pump 16 is switched on or at least operates at high power.

As a result, the high-pressure poppet valve 86 of the oil-separating apparatus can be used in a targeted manner when the ejector pump 16 is supporting the crankcase ventilation and therefore there is a high pressure difference available for oil separation, which high-pressure poppet valve admittedly requires a higher differential pressure, but also offers a better oil separation.

Furthermore, the control apparatus 96 controls a further valve 102, which is arranged between the impactor 40 with the low-pressure poppet valve 84 and the intake tract 13 and is then closed when the switching valve 100 is switched to the impactor 40 with the high-pressure poppet valve 86. In this manner, a backflow of gases through the impactor 40 with the low-pressure poppet valve 84 can be prevented. In this case, the oil-separating apparatus 11 has one own outlet 53, 55 for both impactors in each case.

Otherwise, with regards to design and function, the ninth embodiment of the crankcase ventilation apparatus 10 illustrated in FIGS. 18 and 19 matches the eighth embodiment of the crankcase ventilation apparatus 10 illustrated in FIG. 17, and reference is made to the preceding description thereof in this respect.

Figure 20:
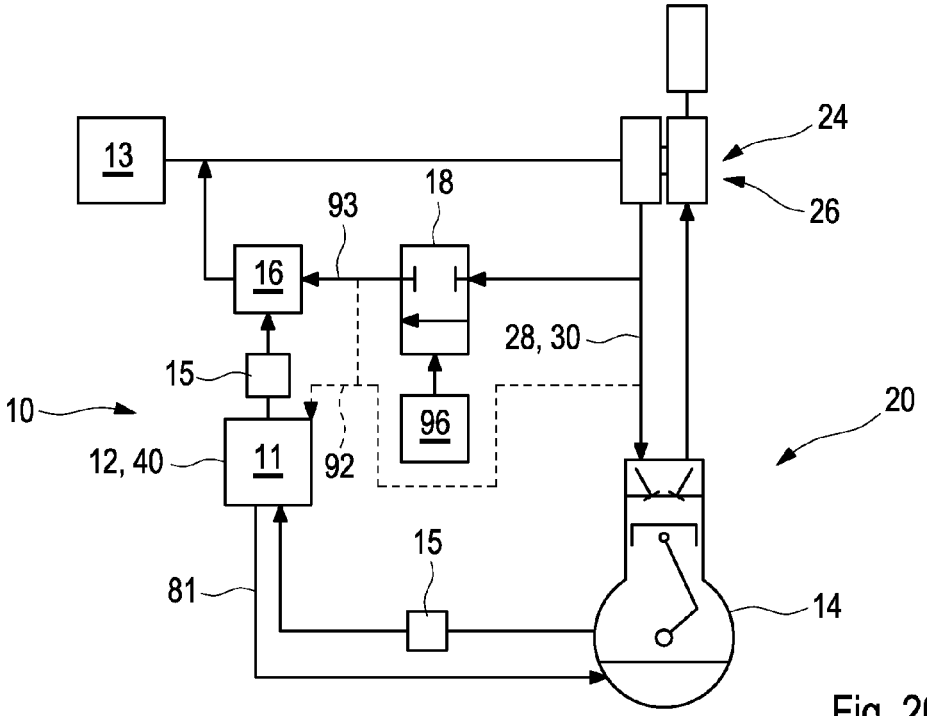
FIG. 20 shows a schematic sketch of an internal combustion engine with a crankcase ventilation apparatus according to a tenth embodiment.

A tenth embodiment of the crankcase ventilation apparatus 10 illustrated in FIG. 20 differs from the fourth embodiment illustrated in FIGS. 11 and 12 in that the pump control valve 18 is controlled by means of a control apparatus 96. The regulation and/or control of the pump control valve 18 by the control apparatus 96 in this case corresponds to the regulation and/or control according to the sixth embodiment of the crankcase ventilation apparatus 10 illustrated in FIG. 15, and reference is made to the preceding description thereof in this respect.

Otherwise, with regards to design and function, the tenth embodiment of the crankcase ventilation apparatus 10 illustrated in FIG. 20 matches the fourth embodiment of the crankcase ventilation apparatus 10 illustrated in FIGS. 11 and 12, and reference is made to the preceding description thereof in this respect.

Figure 21:
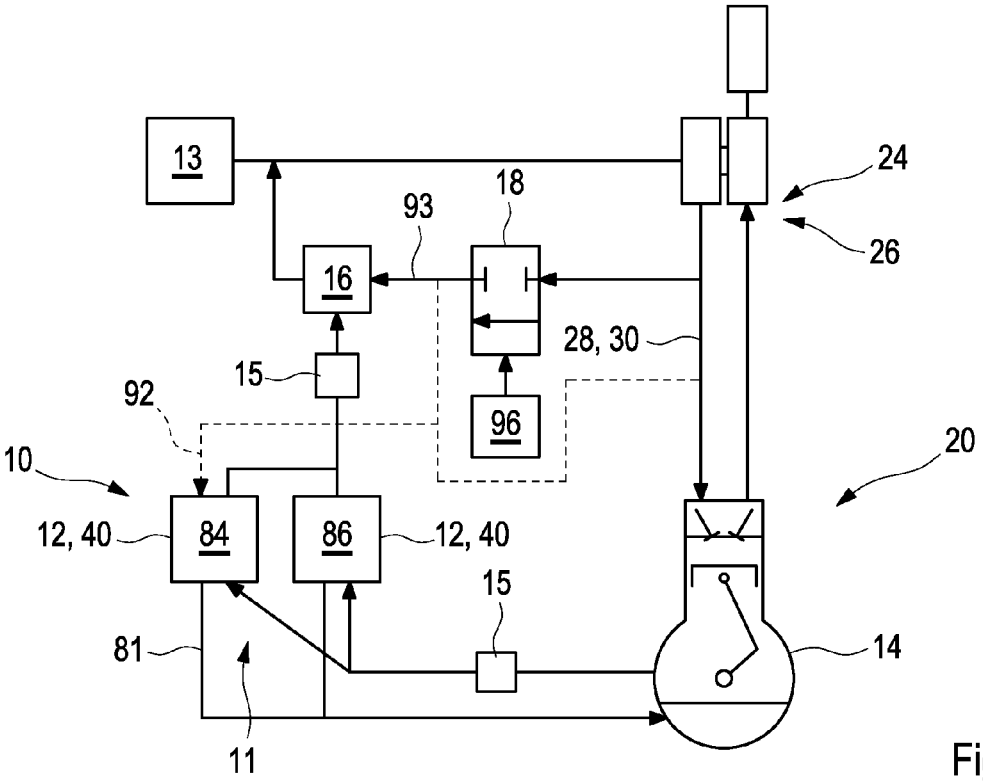
FIG. 21 shows a schematic sketch of an internal combustion engine with a crankcase ventilation apparatus according to an eleventh embodiment.

An eleventh embodiment of the crankcase ventilation apparatus 10 illustrated in FIG. 21 differs from the fifth embodiment of the crankcase ventilation apparatus 10 illustrated in FIGS. 13 and 14 in that the pump control valve 18 is controlled and/or regulated by means of a control apparatus 96. The regulation and/or control of the pump control valve 18 by the control apparatus 96 in this case corresponds to the regulation and/or control according to the sixth embodiment of the crankcase ventilation apparatus 10 illustrated in FIG. 15, and reference is made to the preceding description thereof in this respect.

Otherwise, with regards to design and function, the eleventh embodiment of the crankcase ventilation apparatus 10 illustrated in FIG. 21 matches the fifth embodiment of the crankcase ventilation apparatus 10 illustrated in FIGS. 13 and 14, and reference is made to the preceding description thereof in this respect.

The invention claimed is:

1. A vehicle, comprising:

an internal combustion engine including a crankcase and a supercharging apparatus;

a crankcase ventilation apparatus including at least one inertia-based oil-separating apparatus, the at least one inertia-based oil-separating apparatus including at least one inertia-based oil separator;

an oil return communicating separated oil from the crankcase ventilation apparatus to the crankcase;

an ejector pump driven via a compressed air flow of the supercharging apparatus and configured to generate an underpressure for driving a blow-by gas;

the crankcase ventilation apparatus further including a pump control valve configured to at least one of regulate and control the compressed air flow through the ejector pump, the pump control valve including a closure part arranged force-loaded against a valve seat via a biasing force, wherein the closure part is displaced away from the valve seat counter to the biasing force to open the pump control valve in response to at least one of a pressure difference between a valve inlet and a valve outlet exceeding a pressure difference threshold and an inlet-side pressure of the ejector pump exceeding an inlet-side pressure threshold; and wherein the pump control valve is an own-medium-actuated valve where a medium to be controlled is the same as the medium controlling the pump control valve.

2. The vehicle according to claim 1, wherein the biasing force is at least one of a spring force, a magnetic force and a pneumatic pressure force.

3. The vehicle according to claim 1, wherein the pump control valve is configured as a proportional valve adjustable between a closed position closing the pump control valve and a passage position opening the pump control valve.

4. The vehicle according to claim 1, wherein the oil-separating apparatus includes a plurality of work areas, the plurality of work areas including:

a first work area where a flow cross section of the oil-separating apparatus is constant;

a second work area where a flow cross section of the oil-separating apparatus increases with increasing pressure difference between an inlet and an outlet of the oil-separating apparatus; and a third work area where a flow cross section of the oil-separating apparatus increases less sharply with increasing pressure difference than in the second work area.

5. The vehicle according to claim 1, wherein the oil-separating apparatus includes at least two inertia-based oil separators and a control apparatus configured to switch between the at least two oil separators in response to a power output of the ejector pump.

6. The vehicle according to claim 1, wherein at least one of:

the at least one oil separator is configured as an impactor, and the at least one oil separator is configured as a cyclone.

7. The vehicle according to claim 1, wherein the at least one oil separator includes a poppet valve loaded via a reference pressure forcing the poppet valve in a closing direction.

8. The vehicle according to claim 7, wherein the reference pressure is one of an ambient pressure, a boost pressure of the supercharging apparatus, and a pressure on an inlet-side of the ejector pump.

9. The vehicle according to claim 1, wherein the pump control valve is controlled via a control apparatus.

10. The vehicle according to claim 1, wherein the crankcase ventilation apparatus further includes a throttle valve configured to throttle the blow-by gas.

11. A vehicle, comprising:

an internal combustion engine including a crankcase and a supercharging apparatus;

a crankcase ventilation apparatus including at least one inertia-based oil-separating apparatus, the at least one inertia-based oil-separating apparatus including at least one inertia-based oil separator;

an oil return communicating separated oil from the crankcase ventilation apparatus to the crankcase;

an ejector pump driven via a compressed air flow of the supercharging apparatus and configured to generate an underpressure for driving a blow-by gas;

the crankcase ventilation apparatus further including a pump control valve configured to at least one of regulate and control the compressed air flow through the ejector pump, the pump control valve including a closure part arranged force-loaded against a valve seat via a biasing force, wherein the closure part is displaced away from the valve seat counter to the biasing force to open the pump control valve in response to at least one of a pressure difference between a valve inlet and a valve outlet exceeding a pressure difference threshold and an inlet-side pressure of the ejector pump exceeding an inlet-side pressure threshold; and wherein the at least one inertia-based oil separator includes a poppet valve loaded via a reference pressure forcing the poppet valve in a closing direction and a membrane against which the reference pressure bears, and wherein the poppet valve is loaded via the reference pressure bearing against the membrane.

12. The vehicle according to claim 11, wherein the reference pressure is a boost pressure of the supercharging apparatus.

13. The vehicle according to claim 11, wherein the reference pressure is an ambient pressure.

14. The vehicle according to claim 11, wherein the reference pressure is a pressure on an inlet-side of the ejector pump.

15. A vehicle, comprising:

an internal combustion engine including a crankcase and a supercharging apparatus;

a crankcase ventilation apparatus including at least one inertia-based oil-separating apparatus, the at least one inertia-based oil-separating apparatus including at least one inertia-based oil separator;

an oil return communicating separated oil from the crankcase ventilation apparatus to the crankcase;

an ejector pump driven via a compressed air flow of the supercharging apparatus and configured to generate an underpressure for driving a blow-by gas;

the crankcase ventilation apparatus further including a pump control valve configured to at least one of regulate and control the compressed air flow through the ejector pump, the pump control valve including a closure part arranged force-loaded against a valve seat via a biasing force, wherein the closure part is displaced away from the valve seat counter to the biasing force to open the pump control valve in response to at least one of a pressure difference between a valve inlet and a valve outlet exceeding a pressure difference threshold and an inlet-side pressure of the ejector pump exceeding an inlet-side pressure threshold; and wherein the crankcase ventilation apparatus further includes a throttle valve configured to throttle the blow-by gas.

16. The vehicle according to claim 15, wherein the throttle valve is arranged in a flow path of the blow-by gas between the crankcase and the at least one inertia-based oil-separating apparatus.

17. The vehicle according to claim 15, wherein the throttle valve is arranged in a flow path of the blow-by gas between the at least one inertia-based oil-separating apparatus and the ejector pump.

18. A vehicle, comprising:

an internal combustion engine including a crankcase and a supercharging apparatus;

a crankcase ventilation apparatus including at least one inertia-based oil-separating apparatus, the at least one inertia-based oil-separating apparatus including at least two inertia-based oil separators;

an oil return communicating separated oil from the crankcase ventilation apparatus to the crankcase;

an ejector pump driven via a compressed air flow of the supercharging apparatus and configured to generate an underpressure for driving a blow-by gas; and wherein the crankcase ventilation apparatus further includes a pump control valve configured to at least one of regulate and control the compressed air flow through the ejector pump, the pump control valve including a closure part arranged force-loaded against a valve seat via a biasing force, wherein the closure part is displaced away from the valve seat counter to the biasing force to open the pump control valve in response to at least one of a pressure difference between a valve inlet and a valve outlet exceeding a pressure difference threshold and an inlet-side pressure of the ejector pump exceeding an inlet-side pressure threshold.

19. The vehicle according to claim 18, wherein the at least two inertia-based oil separators are configured as at least one of an impactor separator and a cyclone separator.

20. The vehicle according to claim 18, wherein the at least one inertia-based oil-separating apparatus further includes a control apparatus configured to switch between the at least two inertia-based oil separators in response to a power output of the ejector pump.

* * * * *